United States Patent [19]

Belleville

[11] 4,317,527

[45] Mar. 2, 1982

[54] KNOCK-DOWN ICE CHEST

[76] Inventor: Lawrence R. Belleville, 6061 Hickory La., Washington, Mich. 48094

[21] Appl. No.: 191,542

[22] Filed: Sep. 29, 1980

[51] Int. Cl.[3] ..... B65D 6/24; B65D 81/38

[52] U.S. Cl. ..... 220/4 F; 220/444; 220/467

[58] Field of Search ..... 220/4 F, 4 R, 444, 467, 220/83, 84; 217/12 R, 13, 43 R, 45

[56] References Cited

U.S. PATENT DOCUMENTS 3,570,699 3/1971 Kobagashi ..... 220/4 F
4,125,301 11/1978 Phan ..... 220/462

FOREIGN PATENT DOCUMENTS 2351027 5/1976 France ..... 220/444

*Primary Examiner*—George E. Lowrance
*Attorney, Agent, or Firm*—Cullen, Sloman, Cantor, Grauer, Scott & Rutherford

[57] ABSTRACT

A knock-down ice chest is disclosed which is constructed from separate insulating panels that can be easily assembled and disassembled such that damaged panels may be replaced quickly and inexpensively. Each insulating panel includes a base assembly with an exterior metal covering mounted to one side of the base assembly and an interior insulating metal covering mounted to the opposed side of the base assembly. An insulating material fills the space between the metal coverings to form the insulated panel. The panel base assembly includes two rectangular frames, one larger than the other, which are mounted together in a parallel, side-by-side fashion with the exterior metal covering mounted to the exterior perimeter of the larger rectangular frame and the interior insulating metal covering mounted to the exterior perimeter of the smaller rectangular frame. The insulated panels are connected together by detachable fasteners thereby providing an improved ice chest assembly which effectively eliminates the need for replacing the entire unit when one or more of the insulating panels become damaged.

3 Claims, 3 Drawing Figures

KNOCK-DOWN ICE CHEST

BACKGROUND OF THE INVENTION

The present invention relates to commercial ice chests for use at camping grounds, boat areas, stores and the like, and more particularly, to a knock-down ice chest which is constructed in a manner such that damaged panels may be replaced quickly and inexpensively.

It is conventional to provide ice chests or cabinets at camping grounds, boat areas and the like where a customer may take pre-packaged or loose ice from the ice chest upon payment of a fee. These commercial ice cabinets are typically large box-like structures having a refrigeration unit and a separate container for holding the ice. The ice is stored in the container in pre-packaged or loose form and is kept frozen by the refrigeration unit.

A problem with known commercial ice chests is that the exterior housing can be easily damaged by, for example, a delivery truck backing into it or by other accidents that commonly occur at the locations where these ice chests are used. Very often the interior refrigeration seal is broken when any one of the exterior panels are damaged, and the ice chest is then no longer usable for its intended purpose. Damage to the ice chest normally means that the entire unit must be replaced, which is a very expensive proposition.

Thus, there has been a need for an improved ice chest assembly which effectively eliminates the need for replacing the entire unit when one or more of the exterior panels become damaged.

SUMMARY OF THE INVENTION

In accordance with the present invention, a knock-down ice chest assembly is provided which is constructed from separate panels that can be easily assembled and disassembled.

Each panel includes a base assembly with an exterior metal covering mounted to one side of the assembly and an interior insulating metal covering mounted to the opposed side of the base assembly. A suitable insulating material such as foam plastic fills the space between the metal coverings to form an insulated panel.

The panel base assembly includes two rectangular frames, one larger than the other, which are mounted together in a parallel, side-by-side fashion with one of the rectangular frames having a larger exterior perimeter than the other rectangular frame. The exterior metal covering is in the shape of an open box, and it is mounted to the exterior perimeter of the larger rectangular frame. The interior insulating metal covering also has an open box shape, and it is mounted to the exterior permiter of the smaller rectangular frame. The rectangular frames and metal coverings form a closed box-like structure which is filled with foam plastic, as described, thereby forming an insulated panel.

The insulated panels are connected together to form an ice chest by connecting the exposed edges and corners of the larger rectangular frames with detachable fasteners. A sealant is used between the contacting edges of the rectangular frames to thereby provide an airtight seal. When the panels are assembled, the smaller rectangular frames and insulating metal coverings tightly fit together to form an interior box for holding the pre-packaged or loose ice.

The exterior corners of the assembled ice chest, where the panels intersect, are finished with angle strips that are fastened over the corners to give a finished appearance and to add rigidity to the panel assembly.

If a panel is damaged, it can be removed and replaced quickly and inexpensively by removing the fasteners holding the damaged panel to the remaining ice chest assembly. Thus, the present invention provides an ice chest made from separate panels that can be easily assembled and disassembled for replacement of damaged panels.

Other advantages and meritorious features of the improved ice chest of the present invention will be more fully understood from the following description of the preferred embodiment, the appended claims, and the drawings, a brief description of which follows.

DETAILED DESCRIPTION OF THE INVENTION

Figure 1:
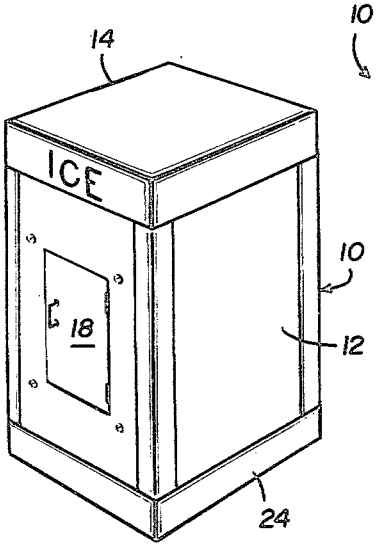
FIG. 1 is a perspective view of the assembled ice chest of the present invention.
Figure 2:
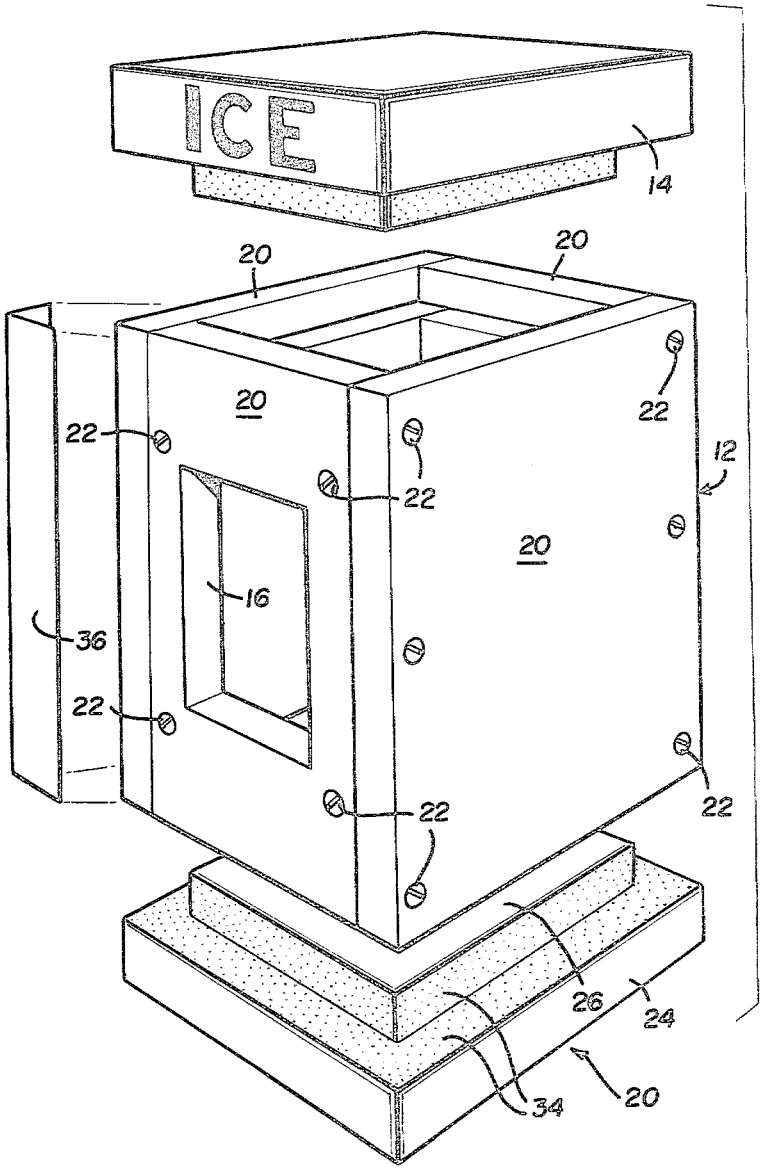
FIG. 2 is a perspective view of the ice chest illustrating its components parts.
Figure 3:
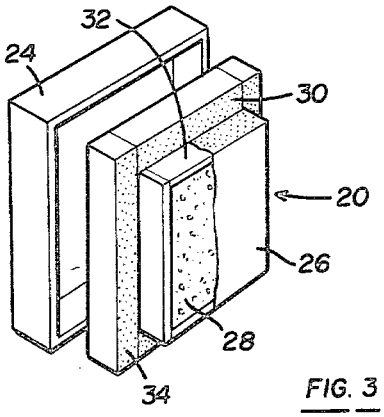
FIG. 3 is a detailed perspective illustrating an individual insulated panel.

A preferred embodiment of the knock-down ice chest made in accordance with the teachings of the present invention is illustrated in FIGS. 1–3.

Referring to FIGS. 1 and 2, the ice chest 10 includes a large box-like structure 12 having a conventional refrigeration unit 14 mounted on the top thereof, an access opening 16, and a door 18. The ice chest 10 is used at camping grounds, boat areas and the like where a customer may take pre-packaged or loose ice from the ice chest upon payment of a fee. The ice is stored in container 12 and is kept frozen by the refrigeration unit 14.

The knock-down ice chest 10 is constructed from separate panels 20 that can be easily assembled and disassembled. The ice chest 10 of the present invention effectively eliminates the need for replacing the entire unit when one or more of the exterior panels become damaged. If one of the panels 20 become damaged, it can be removed and replaced quickly and inexpensively by removing the detachable fasteners 22 holding the damaged panel to the remaining ice chest assembly.

Each panel 20 includes a base assembly with an exterior metal covering 24 mounted to one side of the base assembly and an interior insulating metal covering 26 mounted to the opposed side of the base assembly. A suitable insulating material such as foam plastic 28 fills the space between the metal coverings to form an insulated panel.

The panel assembly includes two rectangular frames 30, 32, which are mounted together in a parallel, side-by-side fashion with rectangular frame 30 having a larger exterior perimeter than the other rectangular frame 32. The exterior metal covering 24 is in the shape of an open box, and it is mounted to the exterior perimeter of the larger rectangular frame 30. The interior insulating metal covering 26 also has an open box configuration, and it is mounted to the exterior perimeter of the smaller rectangular frame 32. The rectangular frames 30, 32 and metal coverings 24, 26 form a closed, box-like structure which is filled with plastic foam 28 thereby forming an insulated panel 20.

The insulated panels 20, as illustrated in FIG. 2, are connected together to form an ice chest 12 by connecting the exposed edges and corners of the rectangular frames 30 with detachable fasteners 22. All of the fasteners 22 pass through the exposed edge areas of the rectangular frames 30 which areas are between the exterior perimeters of frames 30 and 32. Prior to assembly, a sealant 34 is applied to the exposed edge areas on rectangular frames 30. Sealant 34 is also applied to the exterior perimeter edges of metal coverings 26. When the panels are assembled, the contacting edges between the rectangular frames 30 and 32 are thereby provided with an airtight seal. Further, when the panels 20 are assembled, the smaller rectangular frames 32 and metal coverings 26 tightly fit together to form an interior box for holding the pre-packaged or loose ice.

The exterior corners of the assembled ice chest, where the panels 20 intersect, are finished with angle strips 36 that are fastened over the corners to give a finished appearance and to add rigidity to the panel assembly.

As described, if a panel 20 becomes damaged, it can be removed and replaced quickly and inexpensively by removing the fasteners 22 holding the damaged panel to the remaining ice chest assembly. Thus, the present invention provides an ice chest made from separate panels that can be easily assembled and disassembled for replacement of damaged panels.

It will be apparent to those skilled in the art that the foregoing disclosure is exemplary in nature rather than limiting, the invention being limited only by the appended claims.

I claim:

1. A knock-down ice chest assembly comprising:

a plurality of separate insulated panels, each panel including a base assembly with an exterior metal covering mounted to one side of said base assembly and an interior insulating metal covering mounted to the opposed side of said base assembly;

said base assembly including a pair of rectangular frames mounted together in a parallel side-by-side fashion with one of said rectangular frames having a larger exterior perimeter than the other rectangular frame;

said exterior metal covering being in the shape of an open box and said exterior metal covering being mounted to the exterior perimeter of the larger rectangular frame, said interior insulating metal covering being in the shape of an open box and said interior metal covering being mounted to the exterior perimeter of the smaller rectangular frame;

said rectangular frames and metal coverings forming a closed box-like structure and foam plastic filling the space between said metal coverings to form an insulated panel; and said insulated panels being mounted together for easy assembly and disassembly by a plurality of detachable fasteners passing through the exposed edge areas on said rectangular frames which are between the exterior perimeters of the large and small rectangular frames, and said smaller rectangular frames and said interior metal coverings tightly fitting together to form an interior box for holding ice when said panels are assembled.

2. The knock-down ice chest assembly as defined in claim 1 including angle strips being mounted to the exterior corners of the ice chest where the panels intersect.

3. The knock-down ice chest assembly as defined in claim 1 including sealing means being applied to the exposed edge areas of said larger rectangular frames and to the exterior perimeter edges of said interior metal coverings to provide an airtight seal.

* * * * *